United States Patent [19]

Skaggs

[11] 4,181,988

[45] Jan. 8, 1980

[54] ADJUSTABLE SIZE TOILET SEAT

[76] Inventor: Bill Skaggs, 1010 Annin St., Philadelphia, Pa. 19147

[21] Appl. No.: 864,727

[22] Filed: Dec. 27, 1977

Related U.S. Application Data

[63] Continuation of Ser. No. 641,442, Dec. 17, 1975, abandoned.

[51] Int. Cl.[2] ..... A47K 13/00; A47K 13/06

[52] U.S. Cl. ..... 4/237; 4/235; 4/239

[58] Field of Search ..... 4/234, 235, 237, 238, 4/239, 134, 7; 297/236, 237

[56] References Cited

U.S. PATENT DOCUMENTS

| | | | |
|---|---|---|---|
| 1,720,129 | 7/1929 | Kinnard | 4/239 X |
| 2,266,641 | 12/1941 | Joyce et al. | 4/235 |
| 2,388,856 | 11/1945 | Lewis | 4/239 |
| 2,427,953 | 9/1947 | Fishko | 4/7 |
| 2,550,221 | 4/1951 | Calderon | 4/237 |
| 2,575,208 | 11/1951 | Calderon | 4/237 |
| 3,341,867 | 9/1967 | Keen | 4/239 |

*Primary Examiner*—Stuart S. Levy
*Attorney, Agent, or Firm*—Morton J. Rosenberg

[57] ABSTRACT

An adjustable size toilet seat is provided having a primary seat and an auxiliary seat structure which is relatively adjustable to reduce the effective seat opening. The primary seat includes longitudinally extending but laterally spaced side elements having inwardly facing longitudinal edges defining a fixed opening. The auxiliary seat structure includes longitudinally extending and laterally spaced seat elements which are carried by said primary seat for transverse movement relative to each other in adjusting the effective size of the seat opening. Each of the auxiliary seat elements have inwardly facing, longitudinally extending edges which are of the same configuration as the edges of the primary seat and are selectively displaceable from a position underlying a respective side element of the primary seat to a relatively inward position defining a reduced size seat opening.

4 Claims, 4 Drawing Figures

ADJUSTABLE SIZE TOILET SEAT

This is a continuation, of application Ser. No. 641,442, filed Dec. 17, 1975; now abandoned.

BACKGROUND OF THE INVENTION

Adjustability as to size of toilet seats is a matter of convenience and adaptability for use by small children. In the past, auxiliary seats appropriately sized for small children have been provided to meet this problem of enabling small children to utilize the conventionally available toilet facilities. Although the available auxiliary seats which are either removably mounted on the toilet or removably positioned on the top of conventional seats are capable of the intended objective, such auxiliary seats are inconvenient to utilize, often do not provide a stable seat and require storage space. To meet the objections to the auxiliary seats, various forms of size-adjustable seats have been devised with the objectives being elimination of the need for auxiliary seats through ability to selectively increase or decrease the size of the seat opening or the relative spacing of the side elements of the seat.

Adjustable toilet seats as disclosed in the prior art have generally comprised a seat structure including two independent side elements. These side elements are mounted on a common hinged supporting structure for swinging movement as well as being laterally displaceable to effect a change in the size of the seat opening. While these prior art seats have the feature of size adjustability, the structures are relatively complex and the nature of the structures materially detract from the strength obtained with conventional unitary seats. Any separation of seat elements requiring interconnection by additional mechanical means to effect mounting as a unitary seat also substantially increases the cost. Separate seat elements that are not mechanically interconnected have an operating disadvantage of requiring separate swinging of the seat elements.

SUMMARY OF THE INVENTION

To meet the objections to either the auxiliary or the prior art adjustable seats, a novel toilet seat is provided by this invention having the desired capability of adjustment in size between the normal conventional size and a relatively smaller size particularly suitable for children. The seat structure of this invention includes an auxiliary seat structure that is carried by a conventionally sized, primary seat. This auxiliary seat structure is selectively moveable relative to the primary seat to provide, in one position, a seat that is of a size particularly adapted to small children and is conveniently stored beneath the primary seat in a second position.

The auxiliary seat structure comprises two seat elements that are carried by the primary seat for movement independently of each other. Each seat element is of an elongated configuration similar to a major portion of side elements of the primary seat with inner edges that do not project outwardly from those of the primary seat when disposed in the stored position beneath the primary seat. When displaced laterally inward, these auxiliary seat elements form a seat of relatively reduced size. Guideways secured to the bottom surface of the primary seat at the front and rear thereof cooperatively engage end portions of the auxiliary seat which are thereby supported on the primary seat for movement laterally between the two positions.

Mounting of the two auxiliary seat elements on the primary seat results in a particularly useful seat structure having the desired size adjustability. This structural arrangement maintains the strength of the primary seat, retains the unitary construction and provides readily available storage that is most convenient.

These and other objects and advantages of this invention will be readily apparent from the following detailed description of an embodiment thereof and the accompanying illustrative drawings.

DESCRIPTION OF THE DRAWING FIGURES

DESCRIPTION OF THE ILLUSTRATIVE EMBODIMENT

Figure 1:
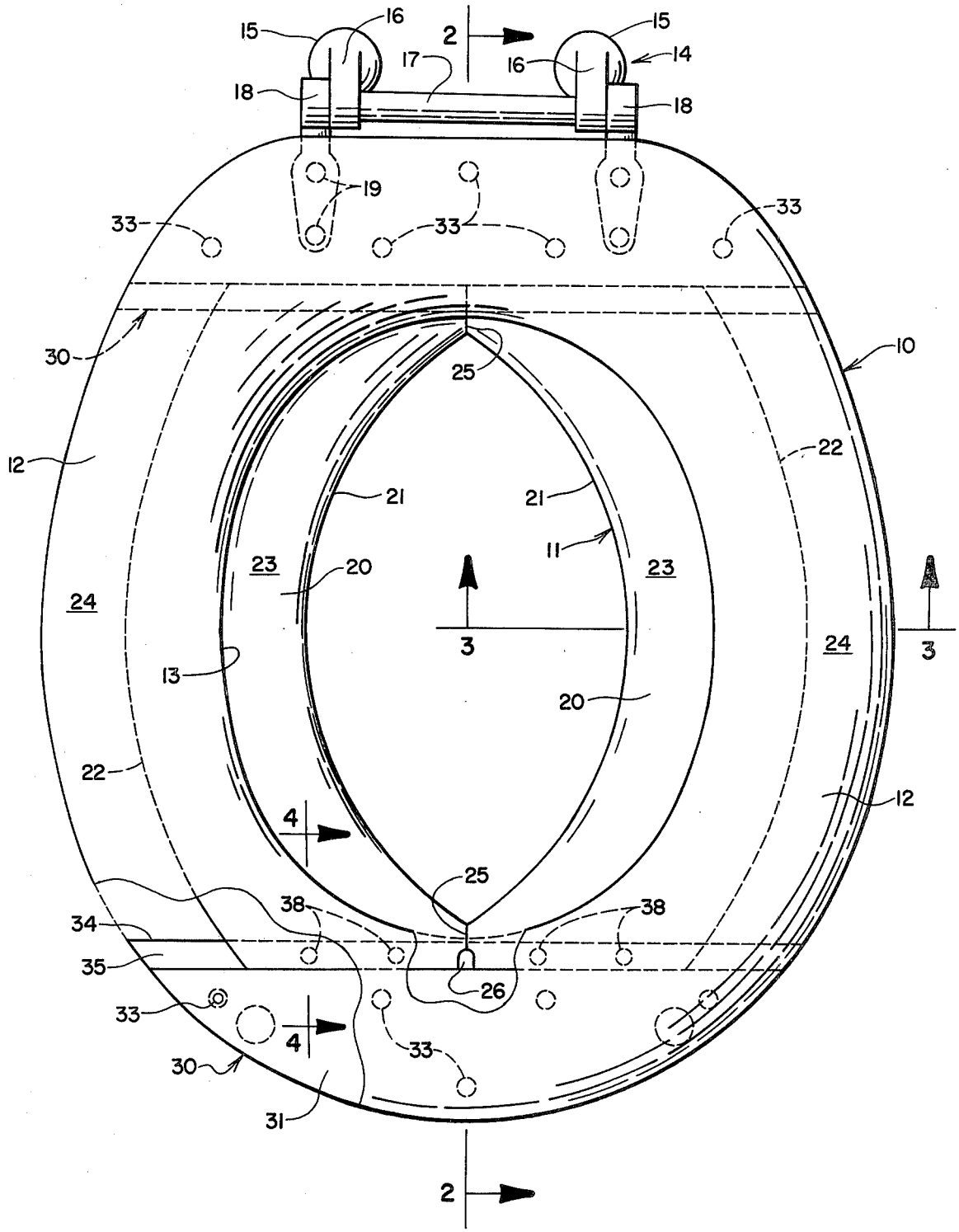
FIG. 1 is a top plan view of a toilet seat provided with an auxiliary seat of this invention.
Figure 2:
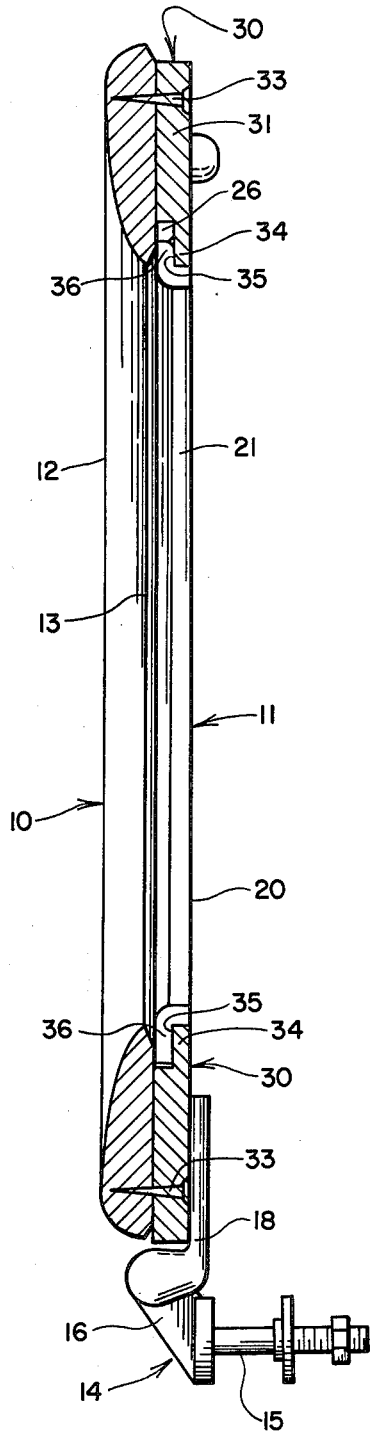
FIG. 2 is a vertical sectional view taken along line 2—2 of FIG. 1.

Referring to the drawings, a toilet seat embodying this invention is shown in the several drawing figures. This seat includes a primary seat 10 and an auxiliary seat structure 11. The primary seat 10 which is of a unitary construction and conventionally sized configuration comprises a pair of elongated side elements 12 that are integrally connected at the front and rear ends. These side elements 12 have inner edges 13 that cooperatively define a central opening of predetermined size.

In accordance with usual practice, the primary seat 10 is secured to a toilet bowl (not shown) by means of conventional hinge structure 14. This hinge structure includes a pair of vertically disposed mounting bolts 15 which are adapted to be secured in respective mounting holes (also not shown) formed in the toilet bowl. A hinge bracket 15 integrally formed with the top end of each bolt 15 supports a hinge pin 17 having an attachment lug 18 secured to each end. Suitable fastening means such as wood screws 19 extend through apertures formed in the lugs 18 and into the primary seat at the rear end thereof.

Figure 3:
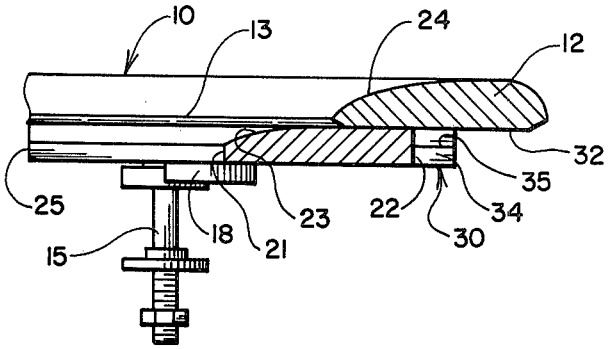
FIG. 3 is a fragmentary vertical sectional view taken along line 3—3 of FIG. 1.

Disposed immediately beneath the primary seat 10 in coplanar relationship thereto is the auxiliary seat structure 11. In accordance with this invention, the auxiliary seat structure comprises a pair of elongated seat elements 20 which are disposed in longitudinally aligned relationship to respective side elements 12 of the primary seat. Each auxiliary seat element 20 is arcuately curved in the horizontal plane having respective inner edges 21 and outer edges 22. The curvature of the seat elements 20 as to the inner and outer edges 21, 22 and width therebetween is such that each seat element will be fully concealed beneath the respective primary seat side element 12 when laterally displaced to a stored position underlying the respective side element. The seat elements 20 are not shown in the inoperative position in the drawings as that position will be obvious from observation of the seat elements being shown in FIG. 1 in an operative position with the inner edges 21 thereof defining an opening of relatively reduced size. Also, in that operative position, it will be noted with reference to FIG. 3 that portions of the upper surfaces 23 of the seat elements 20 are arcuately curved adjacent the inner edges 21 in a manner similar to the upper surface 24 of the primary seat 10 and generally form continuations thereof.

It will be understood that the configuration of the auxiliary seat elements may be modified from that which is illustrated in FIG. 1 to obtain either a differently configured opening that is defined by the inner edges 21. This alteration or modification of the auxiliary seat elements may also be utilized in obtaining a different sized opening. For example, the longitudinal portions 25 forming continuations of the inner edges 21 at either end may be formed in laterally displaced relationship in either direction relative to the illustrated configuration. Depending on the direction of displacement of the longitudinal edge portions 25, the auxiliary seat elements 20 may either be moved further inward to obtain an opening further reduced in size or such inward movement may be further restricted resulting in a relatively larger opening.

Inward movement of the seat elements 20 relative to each other is limited through the longitudinal edge portions 25 coming into contacting engagement with each other. However, to assure that the seat elements 20 will be centrally positioned relative to the primary seat 10 when displaced to the illustrated operative position in FIG. 1, a stop pin 26 is secured to the under surface of the primary seat 10 at the front thereof. This stop pin projects downwardly into the path of movement of the auxiliary seat elements 20 and the longitudinal edge portions 25 at the front are each formed with a cooperative recess to receive the stop pin.

Support of the auxiliary seat structure 11 to permit lateral displacement of the seat elements 20 is provided by a pair of guideways 30. These guideways 30 in the illustrative embodiment are formed by elongated bars 31 extending transversely across the primary seat 10 and secured to the undersurface 32 of the primary seat. Suitable fastening means such as screws 33 may be utilized in securing the guideway bar 31 to the primary seat. Additionally, the screws 19 securing the attachment lugs 18 of the hinge structure extend through the rear guideway bar 31 and into the primary seat.

An outwardly projecting lip 34 is formed along the inwardly facing edges of each guideway bar 31 providing an upper guide surface 35 disposed in spaced relationship to the primary seat undersurface 32. A recess is thereby provided into which a mating lip 36 formed on the axial ends of the seat elements 20 project for support of the seat elements. Each of the auxiliary seat elements 20 is thus carried by the primary seat 10 with the guideways 30 enabling the seat elements to be laterally displaced between the illustrated operative position in FIG. 1 and a stored position completely underlying the side elements of the primary seat.

Figure 4:
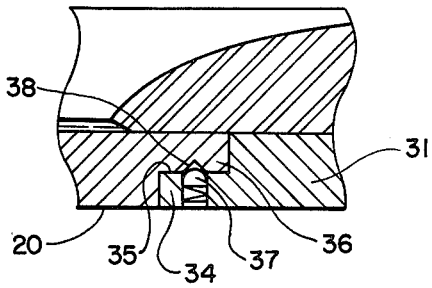
FIG. 4 is a fragmentary vertical sectional view taken along line 4—4 of FIG. 1.

Positive retention of the auxiliary seat elements 20 in either of the two stated positions is accomplished by means of a spring-biased latch pin 37 and sockets 38 as best seen in FIG. 4. The latch pin 37 is mounted in lip 34 of the front guideway bar 31 so as to be normally biased to project upwardly from the guide surface 35. Two sockets 38 are formed in the lower surface of the lip 36 at spaced intervals on each seat element 20 to receive the latch pin with the locations being determined by the positioning of the seat elements. It will be noted that the spacing between the guide surface 35 and the undersurface 32 of the primary seat 10 is substantially the same as the thickness of the lip 36 to prevent vertical displacement of the seat elements.

The guideways 30 may be constructed with different types of guide bars 31 as may be determined advantageous for a particular purpose. While the illustrative embodiment utilizes wood or plastic materials, it is readily apparent that specific structural shapes may be formed from appropriate metals or metal alloys that are resistant to corrosion. It will also be apparent that the auxiliary seat elements 20 and guideways 30 may be integrally formed with a primary seat 10 or they may be provided as an attachment for subsequent assembly with a previously installed primary seat.

It will be readily apparent that a novel adjustable size toilet seat is provided by this invention. The primary seat and auxiliary seat structure form a unitary structure that eliminates storage problems while maintaining the auxiliary seat in close proximity to the toilet for greater convenience in use. The auxiliary seat is readily displaceable between the operative and stored positions and is securely retained in either position.

Having thus described this invention, what is claimed is:

1. An adjustably sized toilet seat, comprising:

(a) a primary seat member having a pair of laterally displaced side elements extending in a longitudinal direction, said primary side elements being arcuately contoured for defining a first arcuate opening, said primary side elements having an inner edge arcuate contour;

(b) auxiliary seat means having a pair of discrete laterally displaced side elements being arcuately contoured for defining a second arcuate opening, each of said auxiliary side elements being slidably displaceable only in a lateral direction with respect to each other and with respect to said primary seat elements for maintaining said second arcuate opening in substantially a similar contour with respect to said first arcuate opening independent of said sliding displacement positional location of said auxiliary side elements;

(c) auxiliary seat side element locking means in said guideways and said auxiliary seat side elements for cooperatively engaging said auxiliary seat side elements and said primary side elements at at least one predetermined position;

(d) said auxiliary side elements being slidingly displaceable within guideways formed within said primary seat member side elements, said guideways extending in said lateral direction.

2. The adjustably sized toilet seat as recited in claim 1 where said auxiliary seat side element locking means includes a spring-biased latch pin extendable from at least one of said side elements and a detent socket formed within another of said side elements for receiving said latch pin.

3. The adjustably sized toilet seat as recited in claim 2 where said latch pin is mounted on one of said side elements of said primary seat member and said auxiliary seat means and said socket formed within the other.

4. The adjustably sized toilet seat as recited in claim 1 where said auxiliary side elements include an upper surface for mating engagement with a lower surface of each of said primary seat side element guideways, said auxiliary side element upper surface having (1) a first planar region and (2) a second arcuate region of similar contour to said inner edge arcuate contour of said primary side elements for maintaining a substantially arcuate envelope between said first opening and second opening.

* * * * *